US011512937B1

(12) United States Patent
Davis et al.

(10) Patent No.: US 11,512,937 B1
(45) Date of Patent: Nov. 29, 2022

(54) AMMUNITION BUCKET

(71) Applicant: Gel Blaster LLC, Austin, TX (US)

(72) Inventors: Eric Alan Davis, Austin, TX (US); Robert Kovacs, Budapest (HU); Colin Guinn, Austin, TX (US)

(73) Assignee: GEL BLASTER LLC, Austin, TX (US)

( * ) Notice: Subject to any disclaimer, the term of this patent is extended or adjusted under 35 U.S.C. 154(b) by 0 days.

(21) Appl. No.: 17/714,367

(22) Filed: Apr. 6, 2022

(51) Int. Cl.
*F42B 39/26* (2006.01)
*F42B 6/10* (2006.01)

(52) U.S. Cl.
CPC ..... *F42B 39/26* (2013.01); *F42B 6/10* (2013.01)

(58) Field of Classification Search
CPC ..... B65D 21/086; F42B 39/26; F42B 6/10; F41A 9/64
See application file for complete search history.

(56) References Cited

U.S. PATENT DOCUMENTS 1,097,690 A * 5/1914 Ward ..... B65D 21/086 220/8
4,193,518 A * 3/1980 Holmes ..... A45F 3/20 222/464.2
2015/0253055 A1* 9/2015 Tsui ..... B65D 15/02 280/655
2018/0118410 A1* 5/2018 Wood ..... B65D 45/22

FOREIGN PATENT DOCUMENTS

GB 2538290 A * 11/2016 ..... B65D 21/086

* cited by examiner

*Primary Examiner* — Jonathan C Weber
(74) *Attorney, Agent, or Firm* — Kirby Drake

(57) ABSTRACT

An ammunition bucket may be provided for preparation of ammunition for toy blasters having greater ease of use with less mess. The bucket may be collapsible having sides that collapse in an accordion style, and the bucket may include a carrying handle. The lid may be sealed and resistant to splashing and leakage. A lower recessed port area may be provided at the lowest portion of the bucket body. This port may be a three-way drain and strain port. The lower recessed port area may include a dispensing valve with a primary control notch and a flap that provides rate control for the valve. The dispensing valve also may include a secondary control notch that limits an opening of the dispensing valve to prevent ammunition from leaving the bucket.

21 Claims, 9 Drawing Sheets

AMMUNITION BUCKET

FIELD OF THE DISCLOSURE

The present disclosure generally relates to an ammunition bucket for a blaster, and more particularly, a Gellet bucket for a blaster.

BACKGROUND

Ammunition buckets for preparation of ammunition such as Gellets or water-based beads for use in blasters have been provided. However, when used for preparation of this ammunition, it can be messy and somewhat hard to use particularly when straining excess water. In addition, there can be some challenges with the portability of the ammunition buckets especially when they are filled with ammunition and water.

SUMMARY

Embodiments of the present disclosure may provide an ammunition bucket for preparation of ammunition for blasters having greater ease of use with less mess. The bucket may be collapsible having sides that collapse in an accordion style, and the bucket may include a carrying handle. The lid may be sealed and resistant to splashing and leakage. The lid may snap onto the bucket body but may be easily removable. The lid may form a good seal to limit splash or disconnection; however, the lid may include a small, tethered vent to disallow vacuum formation during ammunition pours. A lower recessed port area may be provided at the lowest portion of the bucket body. This port may be a three-way drain and strain port in an embodiment of the present disclosure. The lower recessed port area may include a dispensing valve with a primary control notch and a flap that provides rate control for the valve. When the valve is closed and latched, the bucket may be sealed watertight. When the valve is open with the primary control notch in a first position, water may drain from the bucket but no ammunition leaves the bucket. When the valve is open with the primary control notch in a second position, ammunition may dispense from the bucket. The dispensing valve also may include a secondary control notch that limits an opening of the dispensing valve to prevent ammunition from leaving the bucket.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide an ammunition bucket for preparation of ammunition for blasters having greater ease of use with less mess. The ammunition bucket may be more functional as well as provide easier portability. It should be appreciated that the ammunition bucket may be used for preparation of Gellets™ in an embodiment of the present disclosure. As described herein, Gellets™ are colorful, water-based beads that are formed of a water-based material that may be utilized with a toy blaster to burst on impact and evaporate in 30 minutes or less. However, other ammunition may be utilized in the ammunition bucket without departing from the present disclosure.

Figure 1:
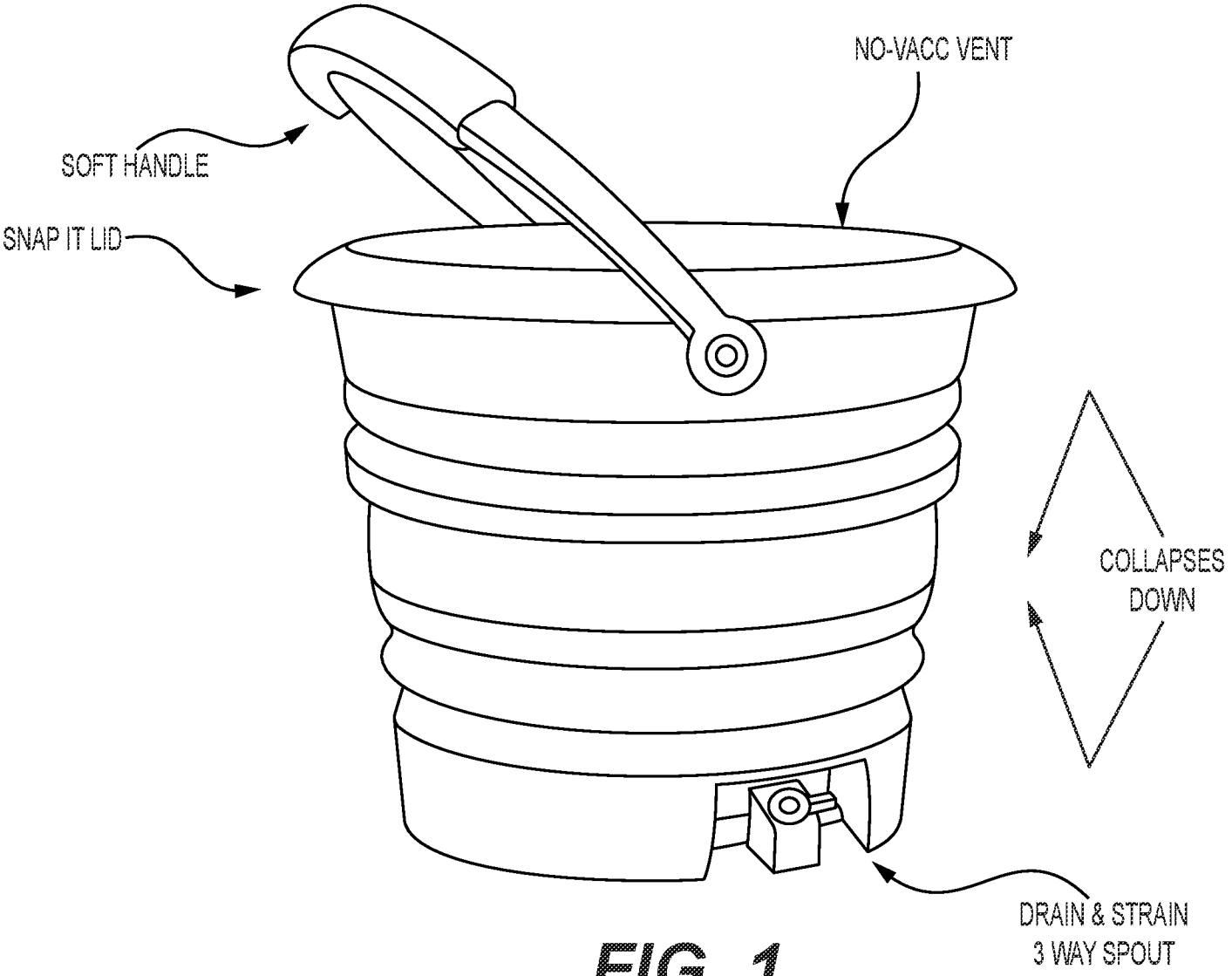
FIG. 1 depicts an ammunition bucket according to an embodiment of the present disclosure.

FIG. 1 depicts an ammunition bucket according to an embodiment of the present disclosure. The bucket may retain the same or greater volume while collapsing into the same or small form factor of the existing product. The bucket may include a carrying handle, similar or with greater ergonomics consideration for the user. The bucket can be very heavy when full, so the addition of a hook and loop-removable cushion may add comfort in embodiments of the present disclosure. The lid may be sealed and resistant to splashing and leakage. The lid may be formed of a semi-flexible plastic in an embodiment of the present disclosure; however, other materials may be used without departing from the present disclosure. The lid may snap onto the bucket body but may be easily removable. The lid may form a good seal to limit splash or disconnection; however, the lid may include a small, tethered vent to disallow vacuum formation during ammunition pours. The sides of the bucket body may collapse in an accordion style. A lower recessed port area may be provided at the lowest portion of the bucket body. This port may be a three-way drain and strain port in an embodiment of the present disclosure.

Figure 2:
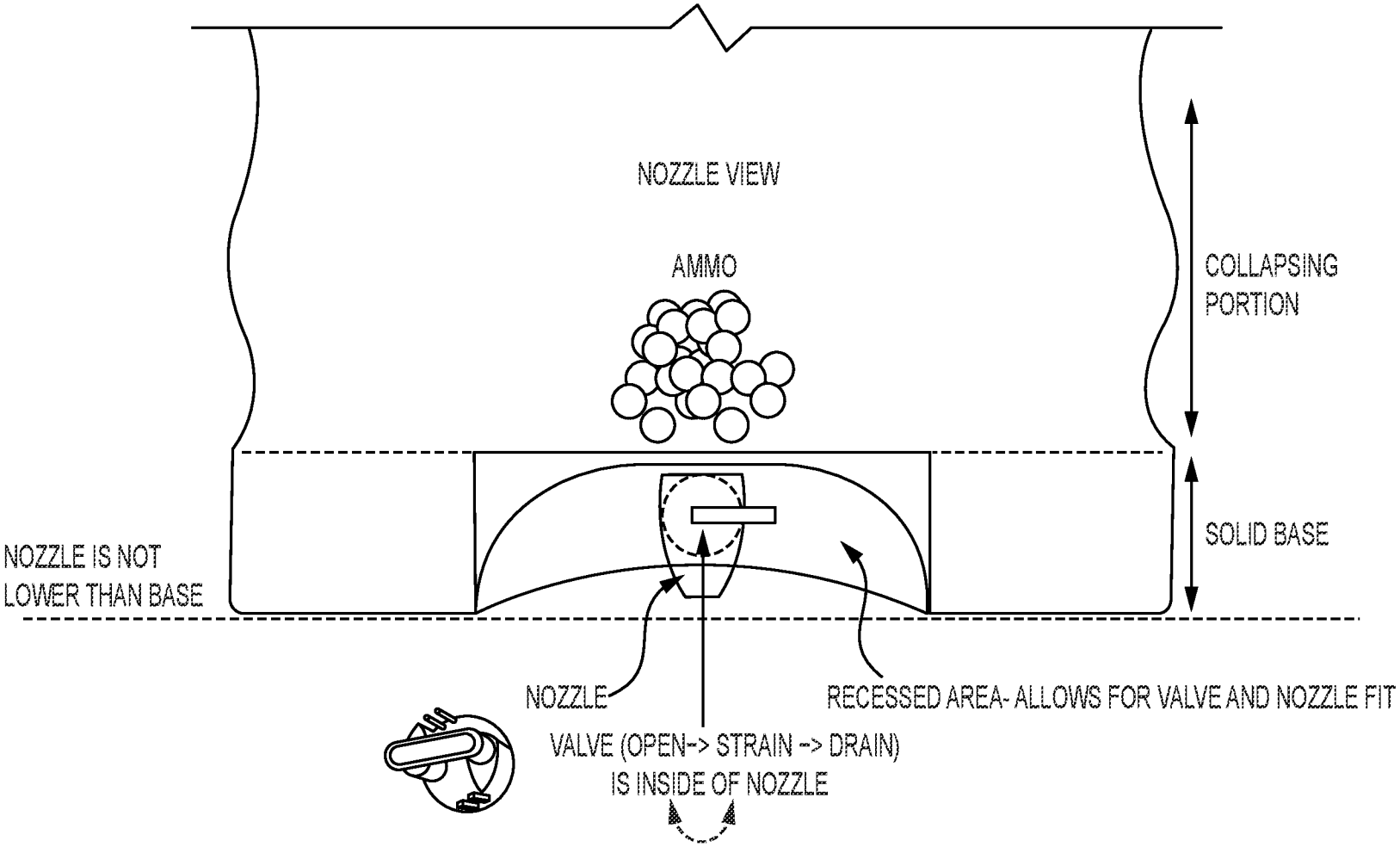
FIG. 2 depicts a nozzle view of an ammunition bucket according to an embodiment of the present disclosure.

FIG. 2 depicts a nozzle view of an ammunition bucket according to an embodiment of the present disclosure. As depicted herein, the sides of the bucket body may be collapsible with a solid base that may include a recessed area allowing for a valve and nozzle fit. There may be a valve inside of the nozzle that may be open to drain and strain in an embodiment of the present disclosure. It should be appreciated that the nozzle may not be lower than the solid base.

Figure 3A:
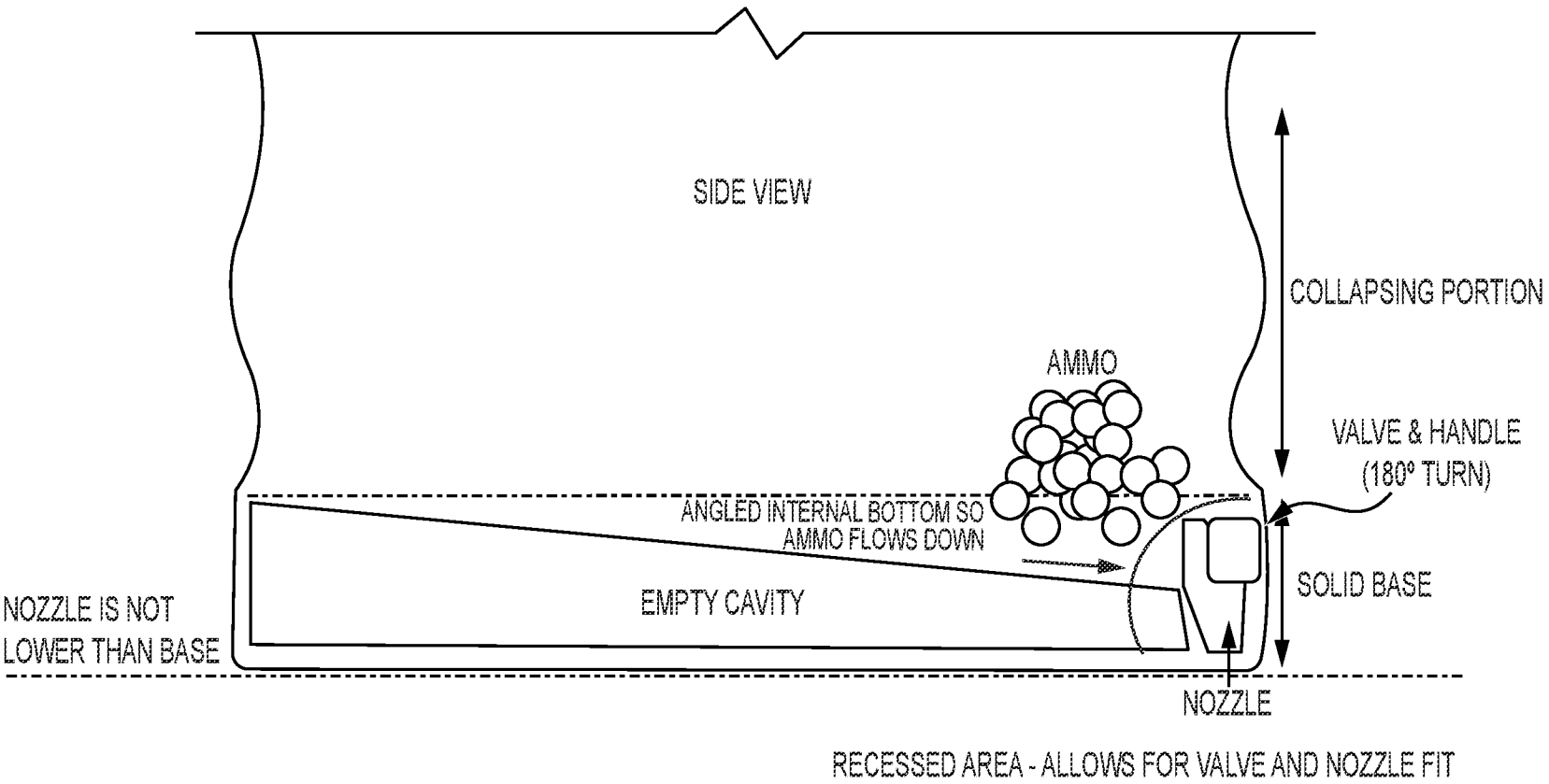
FIG. 3A depicts a side view of an ammunition bucket according to an embodiment of the present disclosure.
Figure 3B:
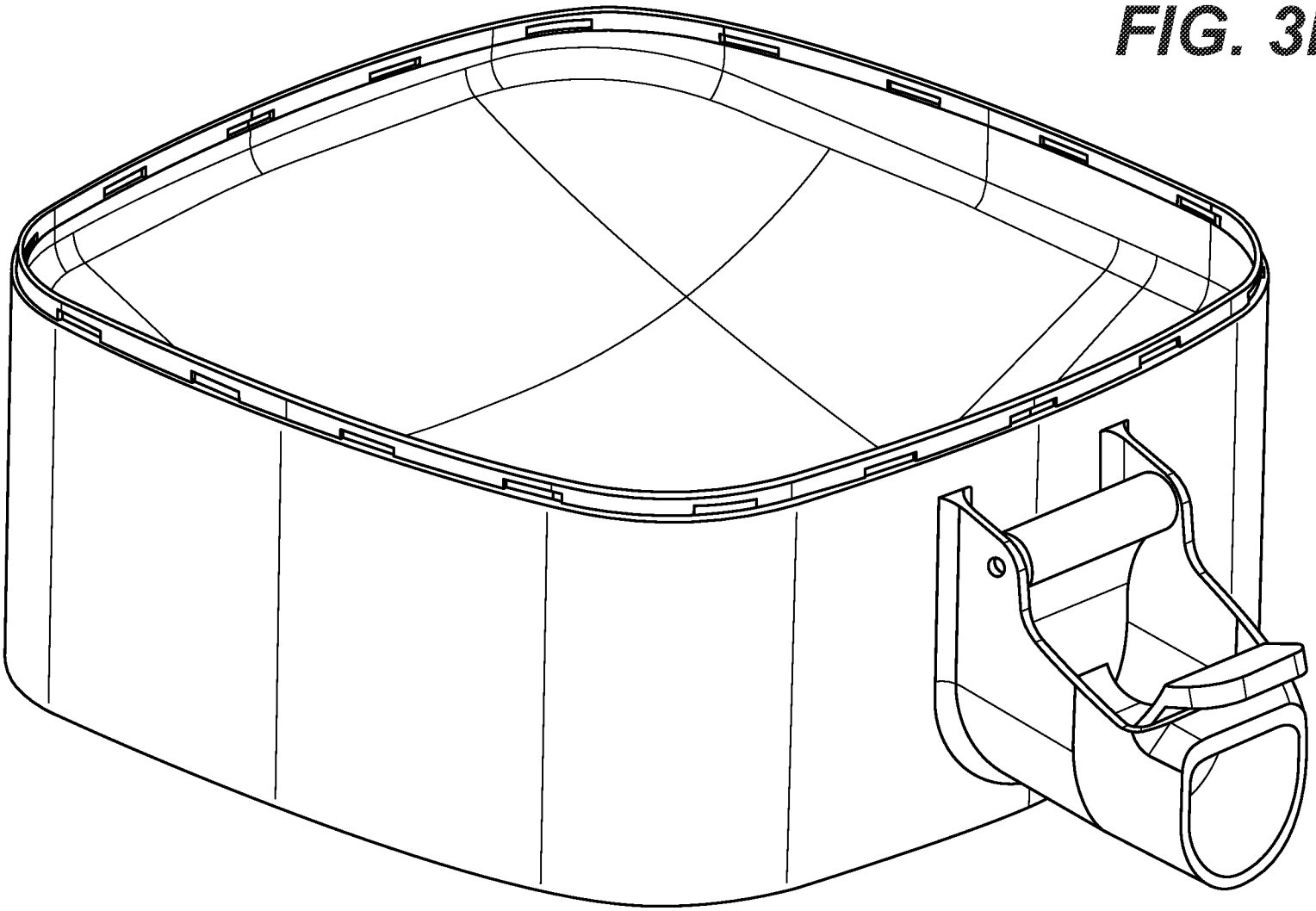
FIG. 3B depicts a solid base of an ammunition bucket according to an embodiment of the present disclosure.

FIG. 3A depicts a side view of an ammunition bucket according to an embodiment of the present disclosure. As depicted in FIGS. 3A and 3B, the inner area of the solid base may be convex or tilted to the lower spout in the recessed area. This may provide an angled internal bottom so that ammunition may flow down toward the nozzle. In an embodiment of the present disclosure, the valve and handle may provide a 180-degree turn. It should be appreciated that the lower recessed port area should not protrude lower than the solid base of the bucket. It also should not be exposed greater than the diameter perimeter of the bucket to avoid damage or opening of the valve.

Figures 4A, 4B, 4C:
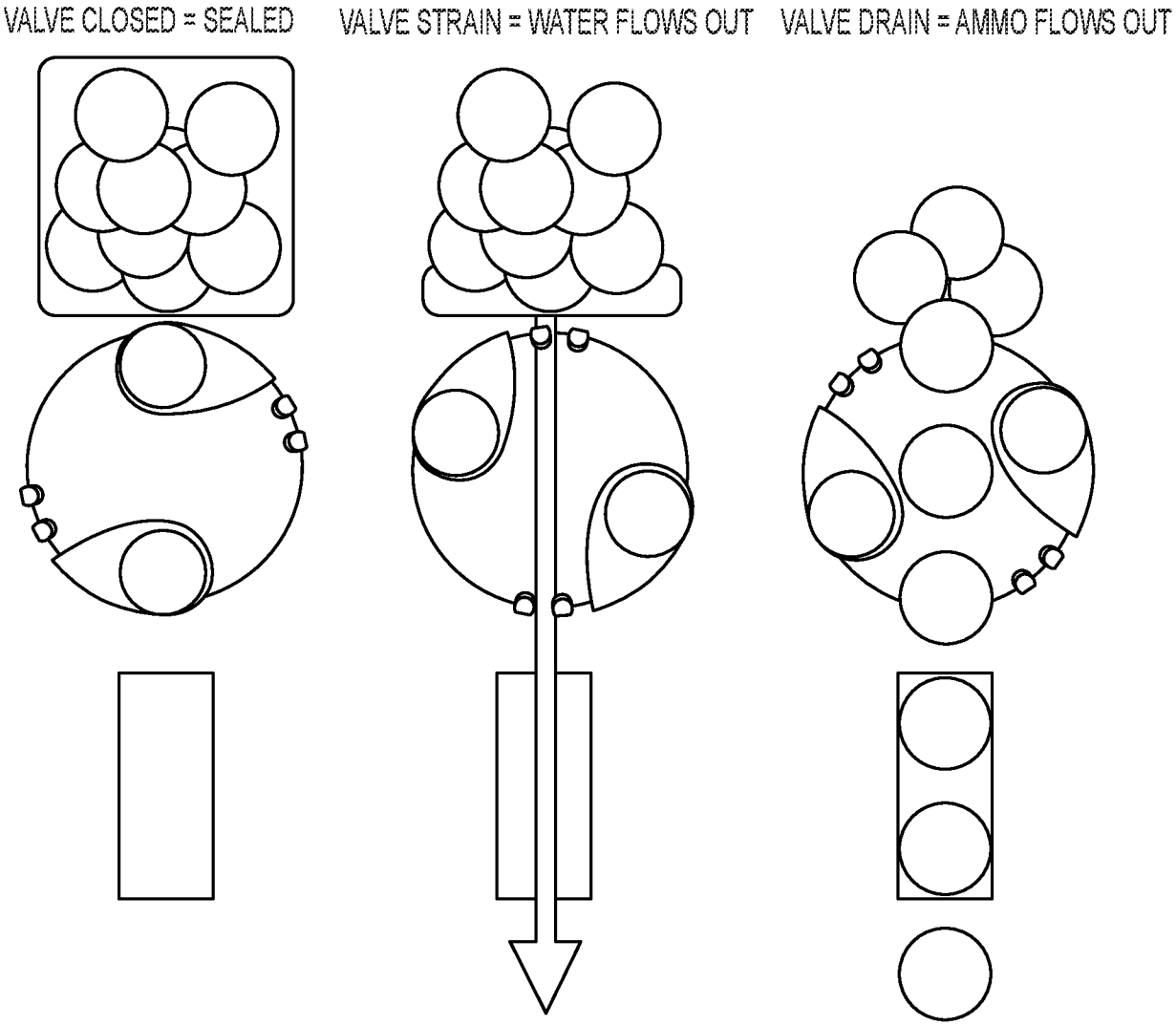
FIGS. 4A-4C depict configurations of a bidirectional twist lock on a valve of an ammunition bucket according to an embodiment of the present disclosure.

FIGS. 4A-4C depict configurations of a bidirectional twist lock on a valve of an ammunition bucket according to an embodiment of the present disclosure. As depicted herein, FIG. 4A depicts when the valve is closed or sealed, FIG. 4B depicts a valve strain configuration when water flows out, and FIG. 4C depicts a valve drain configuration when ammunition flows out. When the valve selector is moved to the left (FIG. 4A), the valve is closed and no water or ammunition may escape the bucket. When the valve selector is in the middle (FIG. 4B), the valve is open to strain. Water may be allowed to escape the bucket, but the ammunition may stay trapped. A screen may be used inside the valve to block the ammunition without damaging the Gellets, while also allowing sufficient water to pass through and empty. When the valve selector is moved to the right (FIG. 4C), the valve is open to filling. Ammunition is allowed to escape the bucket to fill ammunition canisters and hoppers. It should be appreciated that the valve nozzle may have a diameter narrower than 24 mm so that common ammunition canisters may easily be filled without spillage.

Figure 6:
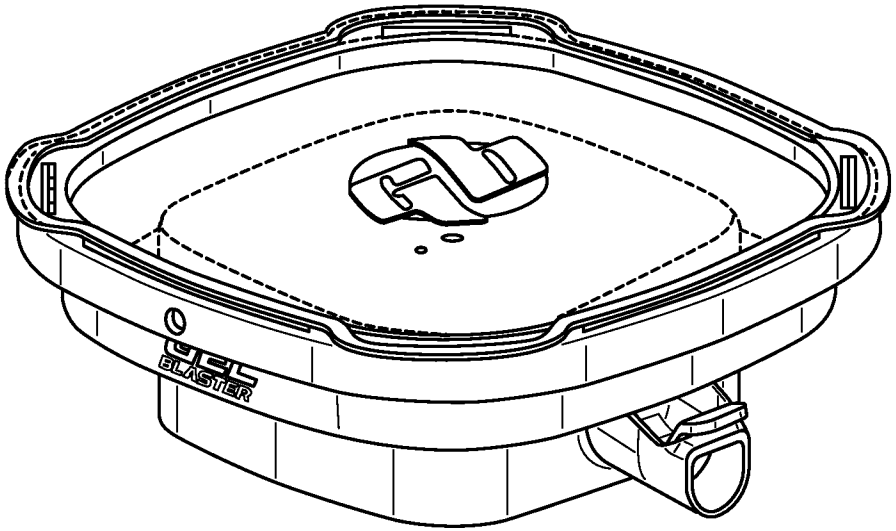
FIG. 6 depicts an ammunition bucket in a collapsed position according to an embodiment of the present disclosure.
Figure 5:
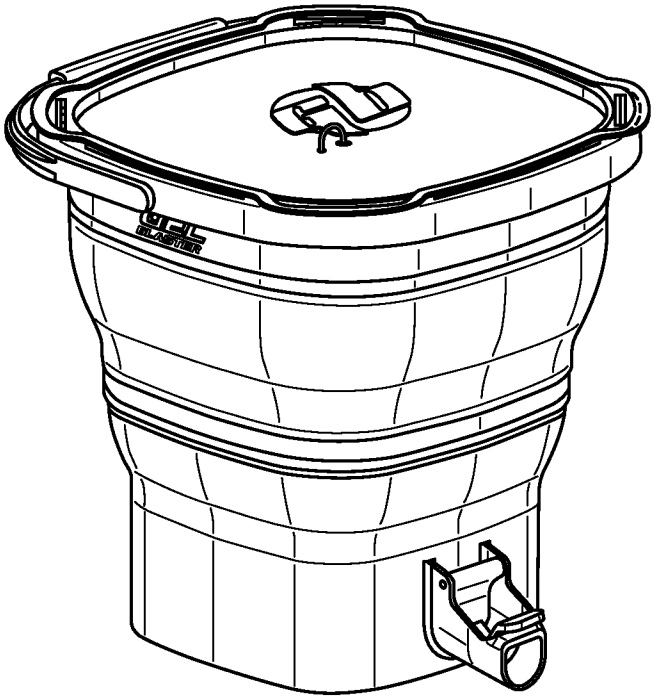
FIG. 5 depicts a front view of an ammunition bucket according to an embodiment of the present disclosure.
Figure 11:
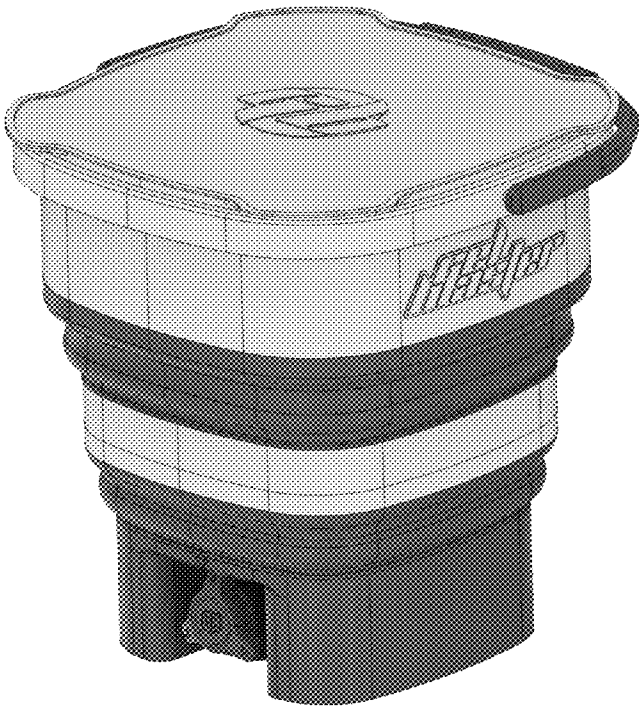
FIG. 11 depicts a front view of an ammunition bucket according to an embodiment of the present disclosure.
Figure 10:
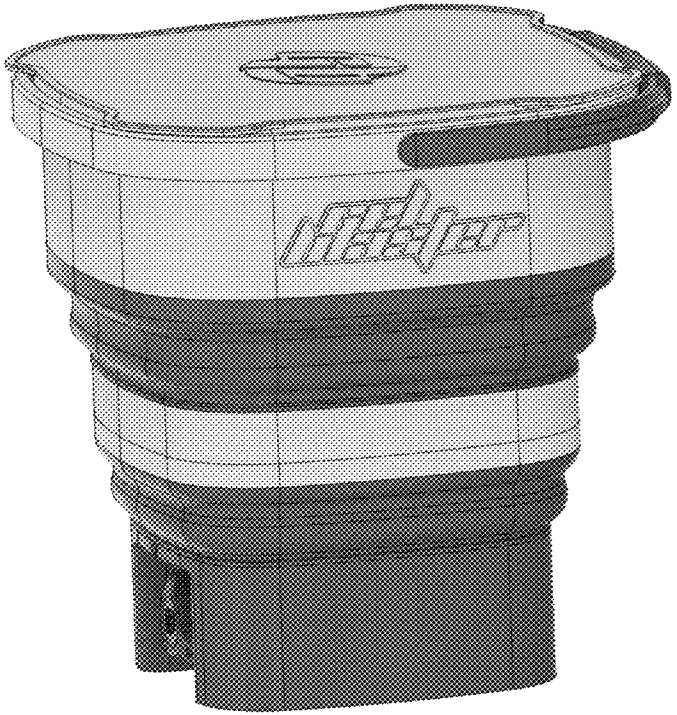
FIG. 10 depicts a side view of an ammunition bucket according to an embodiment of the present disclosure.

FIG. 5 depicts a front view of an ammunition bucket according to an embodiment of the present disclosure. As depicted herein, the bucket may include a carrying handle that may include padding in an embodiment of the present disclosure. The bucket may include a semi-flexible plastic vacuum valve in some embodiments of the present disclosure. FIG. 11 depicts another front view of an ammunition bucket according to an embodiment of the present disclosure, and FIG. 10 depicts a side view of an ammunition bucket according to an embodiment of the present disclosure. FIG. 6 depicts an ammunition bucket in a collapsed position according to an embodiment of the present disclosure. The bucket may retain an internal volume of 1.1 gallons, holding approximately 12,000 Gellets. The sides may collapse "accordion" style as depicted in FIG. 6, with a lower nozzle area at the lowest portion of the base. The collapsed form of the bucket may fit into a box that is 230×75×235 mm in an embodiment of the present disclosure. This may maximize units per container for shipping.

Figure 7C:
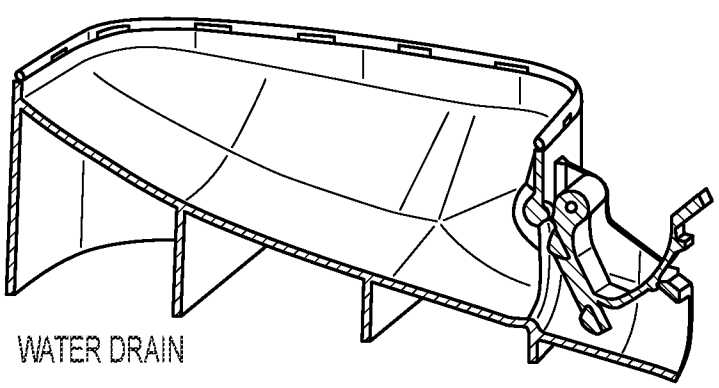
FIGS. 7A-7C depict positions of a locking flap of a dispensing valve according to an embodiment of the present disclosure.
Figure 7B:
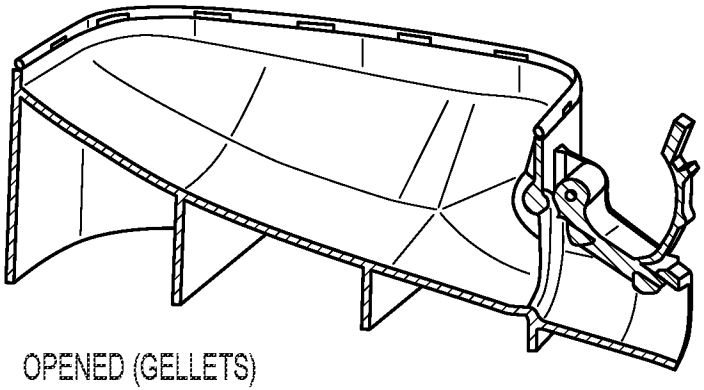
Figure 7A:
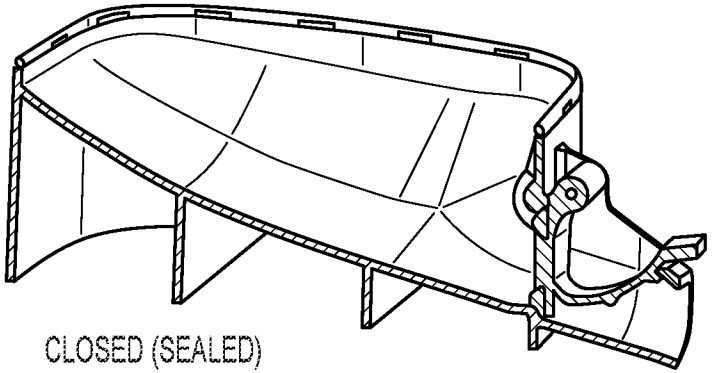

FIGS. 7A-7C depict positions of a locking flap of a dispensing valve according to an embodiment of the present disclosure. When the valve is closed and latched (FIG. 7A), the bucket may be sealed watertight. A primary control notch may ensure that the seal has sufficient force to keep the system watertight. Lifting of a finger-hold may release the primary control notch. When the valve is open in a first position (FIG. 7B), water may be allowed to drain, with no Gellet ammunition escaping. A secondary control notch may limit the opening to less than 6.8 mm gate, preventing Gellets from dispensing. The secondary control notch may serve as an indicator for proper hydration of Gellets. If ammunition is dispensing at the first notch, Gellets are not properly hydrated. When the control notch is left open in the first position, all water will drain when left open and no user input is needed if left open. When the valve is open in a second position (FIG. 7C), Gellets are allowed to escape and freely dispense into a hopper at the front of the valve. The valve can be rate controlled by lifting or lowering the flap. An additional control notch may be used to set the final open position.

Figure 8:
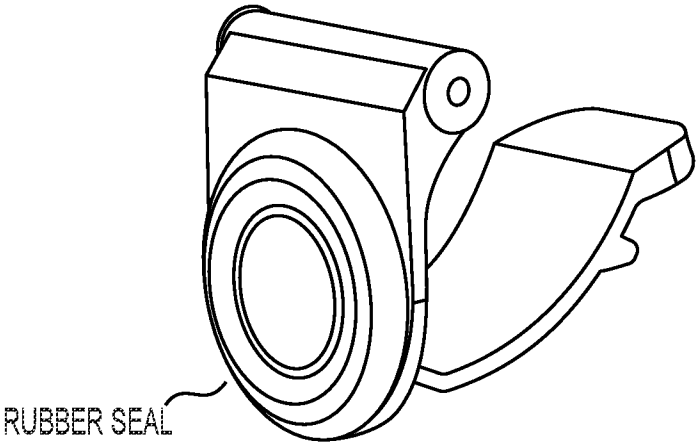
FIG. 8 depicts a valve seal according to an embodiment of the present disclosure.

FIG. 8 depicts a valve seal according to an embodiment of the present disclosure. The shape of the valve seal may disallow Gellet damage, instead forcing any remaining Gellets back into the bucket reservoir instead of being crushed.

Figure 9:
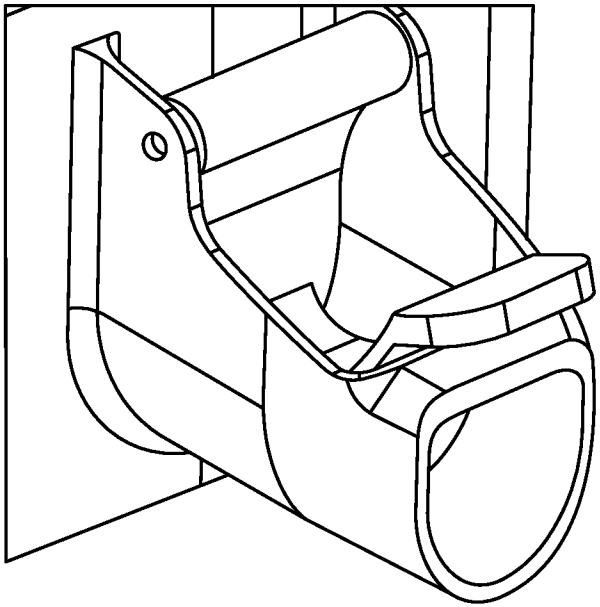
FIG. 9 depicts a valve nozzle according to an embodiment of the present disclosure.

FIG. 9 depicts a valve nozzle according to an embodiment of the present disclosure. The valve nozzle may be at a set diameter and shape so that more common ammunition canisters may be filled without damage.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An ammunition bucket for preparation of ammunition for a blaster comprising:

a body that receives ammunition to be prepared, the body having sides that collapse in an accordion style when not in use;

a removable lid that snaps onto a top portion of the body, wherein the removable lid forms a seal with the top portion of the body to limit splash or disconnection; and a lower recessed port area provided at a lowest portion of the body, the lower recessed port area having a valve with a bidirectional twist lock that closes, drains, and strains ammunition and excess water.

2. The ammunition bucket of claim 1 further comprising:

a carrying handle attached to the body.

3. The ammunition bucket of claim 2 further comprising:

a hook and loop-removable cushion on the carrying handle.

4. The ammunition bucket of claim 1 further comprising:

a small, tethered vent on the lid to disallow vacuum formation during ammunition pours.

5. The ammunition bucket of claim 1, wherein the port area is a three-way drain and strain port.

6. The ammunition bucket of claim 1, the body further comprising:

a solid base in the lowest portion of the body that includes the lower recessed port area.

7. The ammunition bucket of claim 6, wherein the lower recessed port area provides a valve and nozzle configuration, wherein the valve is open to drain and strain.

8. The ammunition bucket of claim 7, wherein the nozzle is not lower than the solid base.

9. The ammunition bucket of claim 6, wherein an inner area of the solid base is convex or tilted to a lower spout in the lower recessed port area.

10. The ammunition bucket of claim 6, wherein the lower recessed port area does not protrude lower than the solid base.

11. The ammunition bucket of claim 6, wherein the lower recessed port area is not exposed greater than a diameter perimeter of the bucket.

12. The ammunition bucket of claim 1, wherein when a valve selector of the valve is moved to the left, the valve is closed and no water or ammunition escapes the bucket.

13. The ammunition bucket of claim 1, wherein when a valve selector of the valve is moved to the middle, the valve is open to strain.

14. The ammunition bucket of claim 1, wherein when a valve selector of the valve is moved to the right, the valve is open to filling so that ammunition is configured to leave the bucket.

15. The ammunition bucket of claim 1, the valve further comprising:

a screen inside the valve to block ammunition from leaving the bucket while allowing water to pass through the valve.

16. An ammunition bucket for preparation of ammunition for a blaster comprising:

a body that receives ammunition to be prepared;

a removable lid that snaps onto a top portion of the body, wherein the removable lid forms a seal with the top portion of the body to limit splash or disconnection; and a lower recessed port area provided at a lowest portion of the body, the lower recessed port area having a dispensing valve with a primary control notch and a flap that provides rate control for the valve.

17. The ammunition bucket of claim 16, wherein when the valve is closed and latched, the bucket is sealed watertight.

18. The ammunition bucket of claim 16, wherein when the valve is open with the primary control notch in a first position, water drains from the bucket but no ammunition leaves the bucket.

19. The ammunition bucket of claim 16, wherein when the valve is open with the primary control notch in a second position, ammunition dispense from the bucket.

20. The ammunition bucket of claim 16, the dispensing valve further comprising:

a secondary control notch that limits an opening of the dispensing valve to prevent ammunition from leaving the bucket.

21. The ammunition bucket of claim 16, wherein the body has sides that collapse in an accordion style when not in use.

* * * * *